United States Patent [19]

Delligatti

[11] 3,964,383

[45] June 22, 1976

[54] RECIPROCATING SELF-CONTAINED MARKING DEVICE

[76] Inventor: Patrick Delligatti, c/o Dalemark Industries, Inc., 950 Airport Road, Lakewood Industrial Road, Lakewood, N.J. 08701

[22] Filed: Sept. 24, 1974

[21] Appl. No.: 508,858

[52] U.S. Cl. ..... 101/44; 101/327; 401/134

[51] Int. Cl.[2] ..... B41F 17/24; B41F 31/24

[58] Field of Search ..... 101/41, 44, 103, 125, 101/327; 401/134

[56] References Cited

UNITED STATES PATENTS

| | | | |
|---|---|---|---|
| 2,501,102 | 3/1950 | Shelton | 401/134 |
| 2,601,700 | 7/1952 | Pinsky et al. | 101/125 UX |
| 2,819,671 | 1/1958 | Porter, Jr. et al. | 101/44 |
| 2,842,046 | 7/1958 | Murray | 101/41 |
| 3,115,826 | 12/1963 | Reinhardt et al. | 101/41 |
| 3,146,703 | 9/1964 | Mason et al. | 101/125 |
| 3,172,356 | 3/1965 | Vosburg | 101/125 |
| 3,402,663 | 9/1968 | Funahashi | 101/327 |
| 3,536,007 | 10/1970 | Harvey | 101/327 |
| 3,572,243 | 3/1971 | Gronau | 101/327 |
| 3,837,276 | 9/1974 | Reichert | 101/41 |

*Primary Examiner*—Clifford D. Crowder

[57] ABSTRACT

A marking device comprises a base affixable to a frame of a continuous processing machine, said base having paired guides thereon and slide blocks slidable on said guides and means including an air operated solenoid valved plunger carried by the guides, and self-contained self-inked printing head mounted on the end of the plunger to print on products passing through the processing machine. The position of the slides and the printing head is adjustable so that the contact pressure of the printing head against the article to be imprinted may be adjusted to provide proper printing contact between the printing head and the object to be printed.

4 Claims, 8 Drawing Figures

FIG. 3
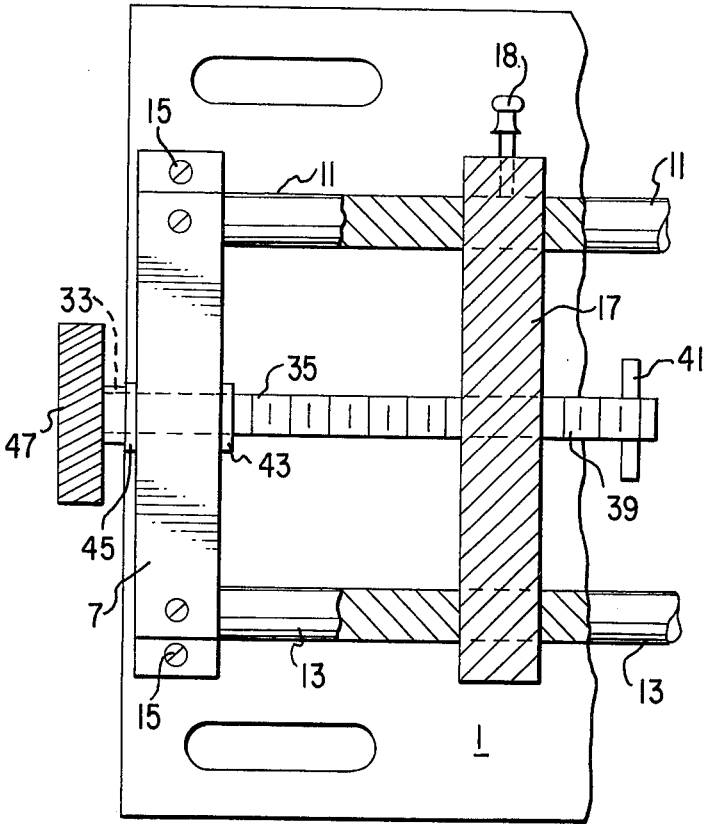
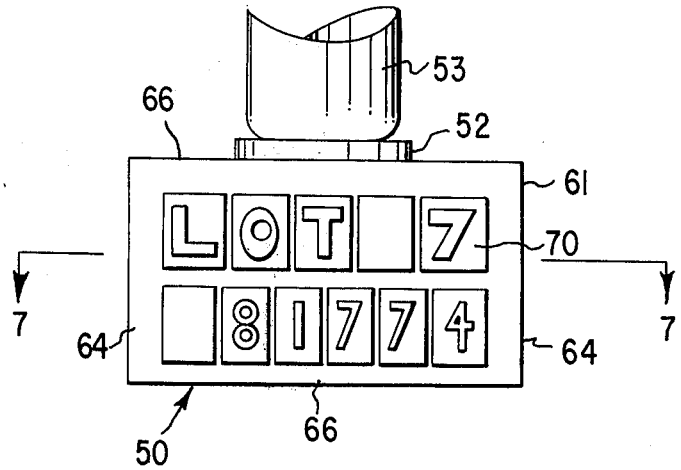
FIG. 4
FIG. 5
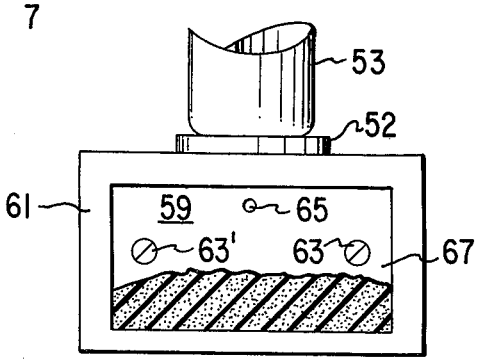

FIG. 6
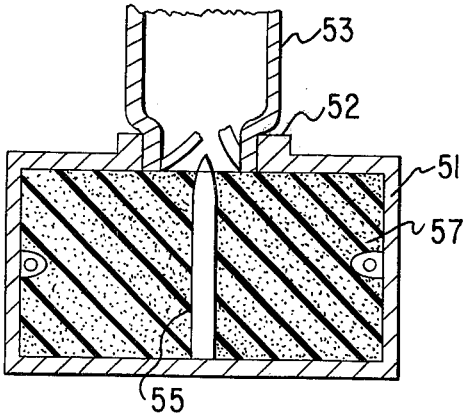
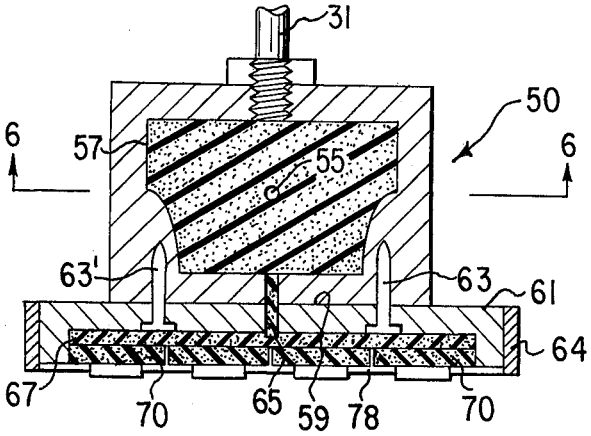
FIG. 7
FIG. 8
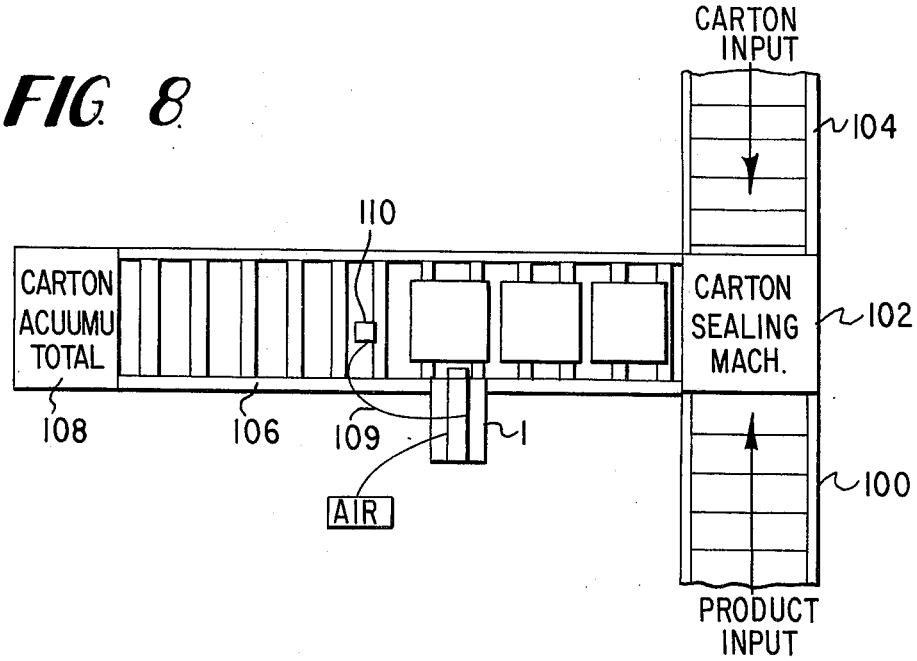

RECIPROCATING SELF-CONTAINED MARKING DEVICE

BACKGROUND OF INVENTION

With the rapid progress being made in automatic machinery, particularly packaging and labeling equipment, as well as upstream processing equipment, it has become vitally important for the processing industry to be able to code mark packages or bottles or various other containers into which the processed products are packed so as to identify the goods and provide statistical information such as date of processing, lot numbers, shift numbers, etc., which data enables the processor to compile data useful in carrying out the processing phase or identifying which products were manufactured at what time, by what shift, from what shift, from what raw material source, under what conditions, just to mention a few of the facts of value to a processing operation. Thus a whole specialized industry, known as the code marking industry, has sprung up in recent years and which is devoted to the design and manufacture of printing apparatus adapted to code or date number individual items or individual packages or containers passing through a continuous production processing line. The code marking or code dating industry has thus developed a vast array of printing devices ranging from specailized printing machines including product conveyors and "spotters" to relatively simple printing devices adapted for incorporation into existing production equipment. It is with such latter devices that the instant invention deals.

Most prior art code printing devices adapted for incorporation into existing processing equipment have comprised some form of base or support which is bolted or otherwise positioned on a convenient frame piece of the processing equipment. The base carries a member usually a rotary member having a type face to imprint on the product or package passing the printing or coding station. The rotary printing member is usually actuated by contact of the product with some form of pivoted arm whereby the product itself moves the rotary member to effect the printing by contact of the type face area with the product or package. After the imprinting is completed and the article passes on down the processing line the rotary member returns automatically to a "null" or start position by some form of spring and cam operator in readiness for the next printing operation. Ordinarily, aside from the rolling contact printing member the base also carries some kind of inking device such as a saturated felt roller, wet from a reservoir of ink, which contacts the type face at each revolution of the rotating member to ink same for each printing. Typical examples of such devices can be found in Delligatti U.S. Pat. No. 3,808,970, Gottscho et al U.S. Pat. No. 2,632,383, Gross U.S. Pat. No. 2,834,287, and Casey U.S. Pat. No. 3,021,783, among others in this art.

Each of the noted patented devices has been found to perform satisfactorily in practical application and one version or the other has been commercially accepted in substantial numbers. However, each shares a common deficiency or deficiencies and that is the fact that the noted devices are relatively slow because after each contact with an article to be imprinted, they must return to the null position before being contacted by the next article on the processing line. Thus, too, the articles must be spaced to allow time for the "null" return before they contact the device. Also, due to the fact that the type face is contact inked from some form of ink roller, the ink must be periodically replenished and sometimes the entire processing line must be halted should the ink source run dry and replenishment be required in the course of a production run.

THE INVENTION

The device which is the subject of this application is designed to obviate the functional difficulties noted above and has for its general objectives the provision of a rapid acting, self-inking code marking machine which does not require interruption of a processing line for replenishment of ink.

Other objects of the invention including the provision of a rugged, simple code marking machine will become apparent to those skilled in the art even though not specifically set forth.

The objects noted are accomplished by means of a code marking machine comprised of a base, a guide means mounted on said base; slide means carried by said guide means for reciprocating to and fro motion relative to said base, said slide means having a manual adjustment means connected thereto to effect said to or fro motion; said slide means having a solenoid operated reciprocal motor means mounted thereon, said motor means having a printing head mounted thereon for contact with the article to be imprinted, said printing head including an ink source, type fonts removably fixed thereto, said type fonts being wettable by capillary action and means for conveying ink from said source to said self-wetting fonts, said ink source being in the form of quick-change, self-contained reservoir.

Having described the novel device in broad terms, its function and details of structure will become readily perceived from a consideration of the following detailed description, reference being made to the appended drawings forming a part thereof and in which.

Figure 1:
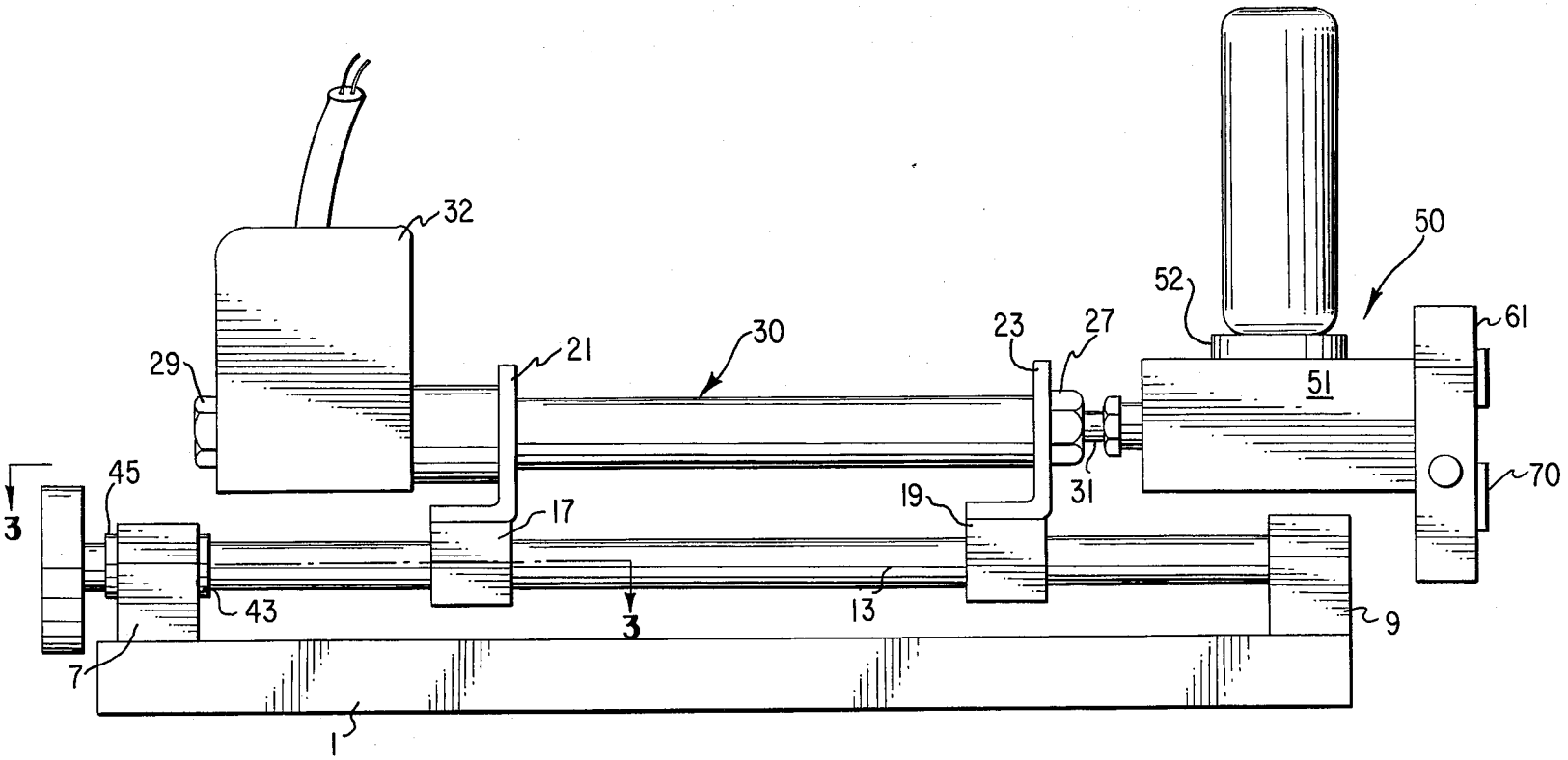
FIG. 1 is a side elevational view of the code marking device.

FIG. 3 is a partial sectional plan view taken along the line 3—3 of FIG. 1, FIG. 4 is a face elevational view of the printing head of the device, FIG. 5 is a view similar to FIG. 4 but with the type fonts and type holder removed, FIG. 6 is a sectional view taken along the line 6—6 of FIG. 7, FIG. 7 is a sectional view in plan of the printing head shown in FIG. 4 and taken along the line 7—7 therein, and, finally, FIG. 8 is a schematic view of a typical packaging line showing the code marking device incorporated therein.

Figure 2:
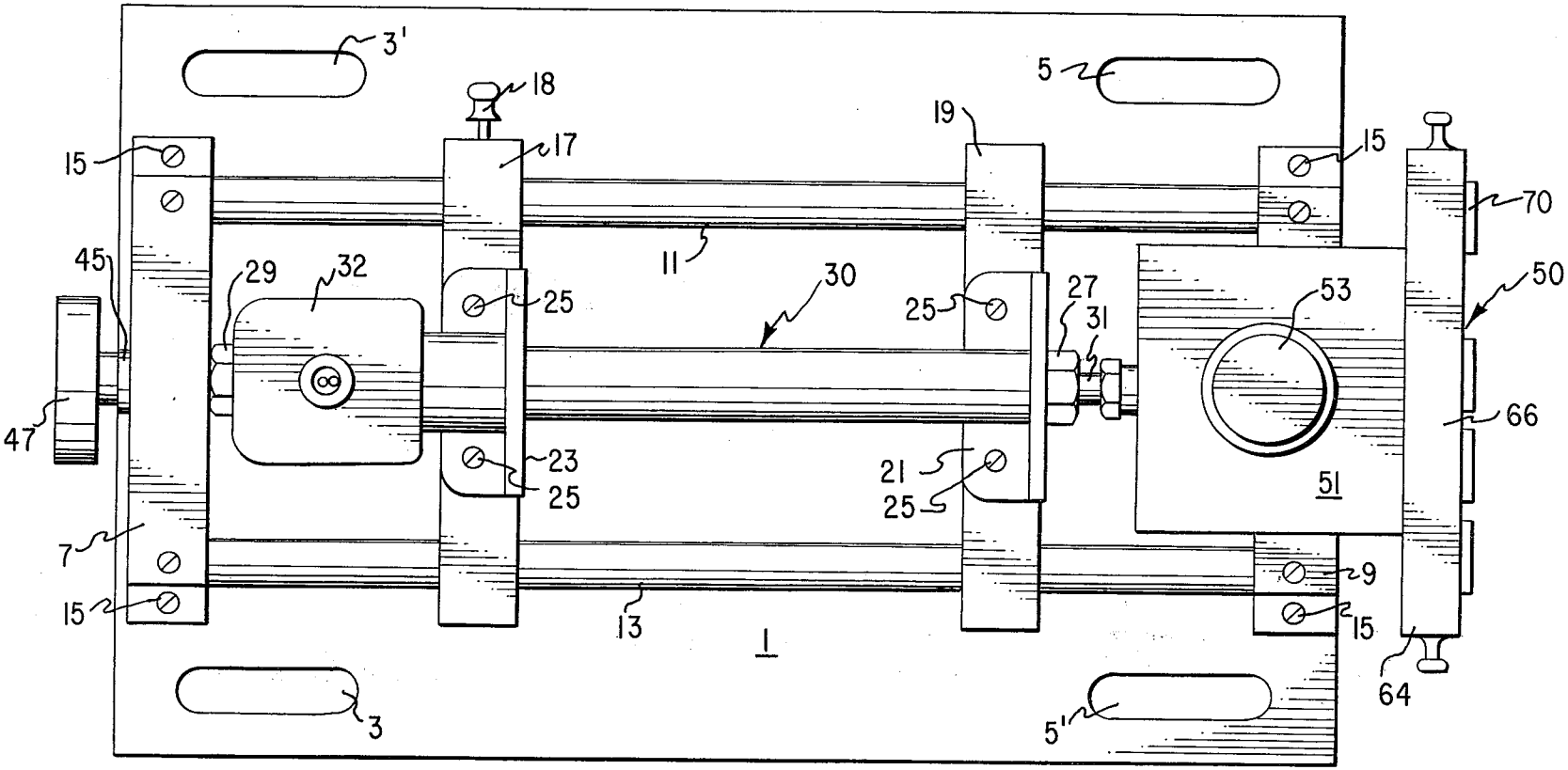
FIG. 2 is a top plan view of the device shown in FIG. 1.

Considering first, FIGS. 1 and 2, it will be seen that the code marking device includes a base 1, essentially a flat, rectangular plate having four slots 3, 3', 5, 5', one each adjacent corner. The longer axes of the slots are parallel to the longer axis of the base 1.

Mounted on base 1, transverse to its longer axis are a pair of slide support blocks 7 and 9. The slide support blocks are parallel to each other and receive in suitable apertures, a pair of slide guides 11 and 13 preferably fabricated of sections of smoothly polished rod or tubing. Various obvious means may be used to anchor the slide guides in the support blocks, one of the simplest being shown in the form of set screws 15.

As noted, the slide guides 11 and 13 are parallel to the longer axis of the base and to each other and the top face of base 1 and are vertically spaced above the base 1 a distance sufficient to accommodate a pair of slider blocks 17 and 19, both of which are freely movable on the slide guides 11 and 13.

Each slide block is provided with an L-shaped mounting bracket 21, 23 suitably affixed as by cap screws 25 or other similar fastening means to the blocks. As shown in FIGS. 1 and 2, block 17 carries bracket 23 and block 19 carries bracket 21. Both brackets are mounted with a horizontal leg bearing on the slide blocks and with their respective vertical legs projecting upwardly and in parallelism with each other.

The vertical legs of the brackets 21, 23 are suitably apertured to receive and support the barrel of a solenoid operated air motor assembly 30 which extends between the brackets parallel to base 1 and centered thereon so as to lie in the same plane as does the longitudinal centerline of the base 1.

Motor assembly 30 will not be described in great detail since it is a commercially available product. Essentially it consists of a piston and cylinder wherein the piston is operated by air pressure to extend a piston rod 31 and an internal spring retracts the piston rod when the air pressure is released. The admission on exhaust of the air pressure is controlled by a solenoid operated valve assembly 32 such that, responsive to a suitable stimulus, the solenoid opens the valve mechanism to admit air to extend the piston rod and extension thereof deenergizes the solenoid and the rod retracts to its normal at rest position.

It should be obvious that variations of the described mechanism are known and their substitution would be apparent to those skilled in the art so long as the essential criteria of true back and forth linear reciprocal motion is effected by the piston rod 31. One preferred device which will perform the noted function is readily available from Air Royal Company of Maplewood, New Jersey, and identified as model AVSM ½ by ½ solenoid controlled air motor.

As shown in FIGS. 1 and 2, the air motor assembly is fixed to brackets 21 and 23 by means of a nut 27 and a bolt 29 which extends through solenoid housing 32 to clamp same to the bracket 21. Again, the mentioned unit 30 is designed for mounting as shown in the drawings and this arrangement need not be belabored in great length. It sufficies to say that the motor assemble 30 aside from its linearly reciprocating function, serves as a slide frame tying the two slide blocks 17 and 19 together as an integral unit which may be moved as a unit to and fro on the slide guides 11 and 13.

Turning attention, now to FIG. 3, it may be seen that the slide support block 7 is provided with a central aperture 33 transversely therethrough. A cylindrical rod 35 extends through the aperture and has one end 37 threadedly engaged with an internally threaded aperture 39 extending transversely through the slide block 17. A suitable diametrically-extending stop pin 41 is provided adjacent the terminal end of the threaded portion 39 of the rod 35.

The opposite or rear end of rod 35 is unthreaded so that it may freely rotate in aperture 33 in slide block 7. Disposed against the two side faces of slide block 7 are a pair of collars 43, 45 which are locked to rod 35 so as to rotate therewith, when the rod is rotated by means of the knurled finger 47 which is fixed to its end as shown in FIGS. 2 and 3. Obviously, rotation of the knob, hence rod 35 will cause slide blocks 17 and 19 and motor assembly 30 to move along slide guides 11 and 13 in a straight line motion toward either end of base 1 depending on the direction in which the rod is rotated. The purpose for this arrangement will become apparent from the subsequent description of the operation of the marking device.

As shown in the drawings, particular reference now being made to FIGS. 4, 5 and 6, the piston rod 31 of the motor assembly 30 carries, at its end, a printing head assembly 50. This unique assembly is comprised of a hollow box-like housing 51 which is attached to the end of piston rod by any suitable means as by being threaded thereon. The top wall of housing 51 is provided with a threaded aperture 52 which receives the externally threaded mouth of a pre-filled ink bottle 53. Extending upwardly from the bottom wall of housing 51 and positioned exactly on the central axis of the circular aperture 52 is a slender pin 55 which pierces the end seal of the ink bottle 53 when same is threaded into the aperture. The entire interior of the housing is filled with a porous sponge-like wick 57 which by capillary attraction conveys the ink discharging from source 53 to the face 59 of housing 51.

Affixed to the front face of housing 51 is a rectangular type font holder 61. Font holder 61 is in essence a shallow rectangular box having its open face directed away from the housing 51 to which is affixed by any suitable means such as countersink machine screws 63, 63'. The interior of the font holder communicates with the interior of housing 61 via one or more ink ports 65. The number of ports may vary, however, from at least one to any number of multiple ports depending on the amount of ink flow that is required to adequately ink the type area.

Disposed adjacent the interior wall of the font holder 61 is a pad 67 of porous material which also becomes ink saturated by capillary action receiving ink from ink port or ports 65 which are also filled with a compatible porous capillary saturated material defining a wick drawing the ink from the interior of housing 61 into the font holder and to pad 67.

The type 70, itself, is also ink saturable being formed of a capillary acting material molded into fonts of the desired design. The particular fonts are manufactured and sold by National Cash Register Co. of Dayton, Ohio, and are referred to in the printing industry as "N.C.R. porous rubber type". Usually the type is composed of individual blocks which are arranged or composed to print the desired code or lot or whatever and are secured in place within the font holder by a removable type claim 72 which for lack of a better description, resembles a ladder having side rails comprised of L-shaped channels 64, 66 which engage the outer sides of the font holder and have one leg overlying the marginal edges of the fonts 70 and a cross bar or stile 78, of which there may be one or more, engaging the individual type faces but lying in a plane beneath that of the type itself so as not to interfere with contact of the type with the article to be imprinted. This arrangement is shown in FIG. 6, in particular.

It should be apparent, also, that the fonts could be incorporated into one single unit in a situation where for example the printed information is to be the same in continuous repetition. In such cases the font holder configuration would be designed so that the cross bar or stile whether just one or more, would be accommodated between or below the actual type face so as not to interfere with the type contact with the surface to be printed.

While the function of the ink feed system has been at least partly described, because of its uniqueness a complete review is believed to be in order. As shown, the ink source is comprised of a reservoir 53 which is screw threaded into the compatibly dimensioned aperture 51 in the top of housing 51.

Preferably, but not necessarily, the ink reservoir is defined as a pre-filled container having a puncturable seal which is pierced and opened by pin 55. By supplying ink in pre-sealed, pre-packaged form the quality may be controlled consistently particularly as regards viscosity, color, etc.

By a combination of gravity and the motions of the head and also capillary action the ink flows down and completely permeates the porous filler 59. The ink then is drawn by capillary action through port 65 by the wick 66 and in turn is uniformly spread out by porous pad 67 where it may uniformly penetrate the back of the type 70.

By a careful selection of porosity of the filler material 57, the number of ink ports 65, wick characteristics and pad 67, the rate of flow of the ink to the type and through the type may be closely metered to match the rate at which the ink is removed from the type face during the printing operation regardless of the speed thereof or the total typing area that might be utilized within the limits of the type carrier 61.

Having described the structural details of the printing device consideration will now be given to its operation.

OPERATION

Referring to FIG. 7 there is shown a typical packaging line in schematic form. The products are fed by power conveyor 100 to the loading and carton sealing station 102. The product is fed to the carton filling and sealing device 102 from a power conveyor 104, is cartoned and the filled containers are ejected in a continuous flow from the closing and sealing operation along a further power conveyor 106 toward a carton accumulator station 108 where the cartons are assembled on pallets or whatever for subsequent distribution of the product into whatever market place it may be destined.

In the example, let it be presumed that the product is a food product which because of its nature must be handled and prepared with extreme care to prevent contamination or spoilage. In such a situation, the processor will and must keep accurate records as to date of processing, the variables in the processing and the raw materials from which the end product is produced.

Such information can be derived by assigning lot numbers and dates to the products produced at any given period and relating all of the data concerning the production of a given series of products to the particular lot number. Thus, if for example, a random sampling of finished products is indicative of sub-par quality or perhaps even contamination, the sampled product is identified by its lot number and it can be presumed that all products bearing that lot number are subject to the same deficiency and should be recalled from distribution to the potential consumers.

The subject marking device performs the lot identification and production date function on the noted production line. Base 1 is fixed to the conveyor frame or to a standard adjacent the frame of conveyor 106 at a suitably convenient place where the unit can be easily reached for service. The solenoid operated motor is connected to a source of air pressure and the solenoid by conventional wiring 109 to a sensor means 110 disposed in the path of movement of the cartons. The sensor can be one of a myriad of different types the obvious choice being a socalled "electric eye". It suffices to state that when the sensor 110 detects an article moving along the conveyor it causes the solenoid to "fire" and piston rod 31 is extended to carry the printing head 50 into contact with the article to imprint the required information thereon.

In positioning the marking device, it should be so located that the force of contact between type face and the article is just sufficient to imprint the product or carton or whatever but not sufficient to cause impact damage to either product or type fonts. Accordingly, the elongated mounting slots 3,3', 5 and 5' provide for rather concise adjustment of the unit laterally toward and away from the path along which the products move on conveyor 106. Fine adjustment to just the precise contact or "kiss" of the type face against the product can be effected by manipulation of the knurled knob 47 and hence the threaded rod 35 which moves the whole assembly including slide blocks 17 and 19 and the air motor assembly 30 and printing head 50 in minute increments either toward or away from the path of movement of the products. Preferably once adjusted the assembly is locked into position against accidental movement by means of a lock screw 18 which is threadedly engaged with slide block 17 and bears against slide guide 11 to frictionally lock the two against any relative movement.

From the above description it may be seen that a simple quick-acting, self-inking marking device has been provided to effect the desired results and that various changes and modifications thereof will occur to those skilled in the art, all of which fall within the purview and scope of the concept as defined in the appended claims, wherein:

What is claimed is:

1. A printing device for encoding production data on moving articles comprising a plate-like base, a slide guide means on said base; a slide assembly carried by said slide guide means and movable toward and away from one edge of said base; said slide assembly including a printing head for imprinting moving articles and a motor means connected to said printing head for reciprocating said printing head from a null position into contact with the article and returning said printing head to the null position;

means for independently advancing or retracting said slide assembly along said base in the same path of reciprocation as that of said printing head;

said printing head being of the capillary action-wettable type, including a source of printing ink located adjacent the back of said type and means for feeding ink from said source to the back of said type for inking thereof;

said feeding means includes a chamber for receiving ink from said ink source, said chamber being filled with a porous capillary action-wettable filler, a port in said chamber leading to the outside of said chamber behind said capillary wettable porous type, a uniformly permeable pad disposed between said port and the back of said porous type and wick means in said port to convey ink from the wettable filler through said port and to said permeable pad, said permeable pad acting to distribute ink uniformly behind the entire type area.

2. A device as defined in claim 1, wherein said ink source is defined by a pre-filled reservoir removably threaded into a reservoir receiving aperture in the top of said chamber and in communication with the interior thereof.

3. A printing device as defined in claim 2, wherein the interior of said housing is provided with an upwardly projecting pin centered beneath said reservoir receiving aperture to pierce the reservior seal as the reservior is threaded into said aperture.

4. A printing device as defined in claim 1 wherein said independent advancing or retracting means comprises a slider block mounted on said slide guide means and connected to said slide assembly, a manually operable screw means fixed to said base and threadly engaged with said slider block whereby rotation of said screw means in one direction or the other causes said slide assembly to move longitudinally in one direction or the other across said base.

* * * * *